US008876921B2

(12) United States Patent
McRobbie et al.

(10) Patent No.: US 8,876,921 B2
(45) Date of Patent: Nov. 4, 2014

(54) HYDROCARBON COMPOSITIONS

(75) Inventors: Ian Malcolm McRobbie, Mickle Trafford (GB); Siobhan Margaret Casey, Manchester (GB); Matthew Robert Giles, Hoole (GB)

(73) Assignee: Innospec Limited (GB)

( * ) Notice: Subject to any disclaimer, the term of this patent is extended or adjusted under 35 U.S.C. 154(b) by 422 days.

(21) Appl. No.: 12/669,920

(22) PCT Filed: Jul. 21, 2008

(86) PCT No.: PCT/GB2008/050605

§ 371 (c)(1),
(2), (4) Date: Feb. 18, 2010

(87) PCT Pub. No.: WO2009/013536

PCT Pub. Date: Jan. 29, 2009

(65) Prior Publication Data

US 2010/0175315 A1 Jul. 15, 2010

(30) Foreign Application Priority Data

Jul. 20, 2007 (GB) ..... 0714175.7
Jul. 28, 2007 (GB) ..... 0714724.2

(51) Int. Cl.

| | |
|---|---|
| ***C10L 1/18*** | (2006.01) |
| ***C10L 1/14*** | (2006.01) |
| ***C10L 10/02*** | (2006.01) |
| ***C10L 10/00*** | (2006.01) |
| *C10L 1/222* | (2006.01) |
| *C10L 1/236* | (2006.01) |
| *C10L 1/196* | (2006.01) |
| *C10L 1/24* | (2006.01) |

(52) U.S. Cl.

CPC ..... *C10L 1/143* (2013.01); *C10L 1/2225* (2013.01); *C10L 1/2364* (2013.01); *C10L 1/2222* (2013.01); *C10L 1/1966* (2013.01); *C10L 1/2362* (2013.01); *C10L 1/2366* (2013.01); *C10L 10/02* (2013.01); *C10L 1/2493* (2013.01); *C10L 1/2437* (2013.01); *C10L 1/2475* (2013.01); *C10L 10/00* (2013.01)

USPC ..... 44/355; 44/359; 44/361

(58) Field of Classification Search

USPC ..... 44/355, 359, 361

See application file for complete search history.

(56) References Cited

U.S. PATENT DOCUMENTS

| | | | | |
|---|---|---|---|---|
| 2,680,756 | A | | 6/1954 | Pauson |
| 2,804,468 | A | | 8/1957 | Arimoto |
| 2,818,417 | A | | 12/1957 | Brown et al. |
| 3,127,351 | A | | 3/1964 | Brown et al. |
| 3,578,421 | A | | 5/1971 | Andress et al. |
| 3,652,238 | A | | 3/1972 | Bialy et al. |
| 3,676,347 | A | | 7/1972 | Frangatos |
| 3,677,725 | A | * | 7/1972 | Andress ..... 44/393 |
| 3,758,283 | A | | 9/1973 | Matt |
| 3,811,848 | A | | 5/1974 | Johnson |
| 3,917,466 | A | | 11/1975 | Henry, Jr. |
| 3,961,916 | A | | 6/1976 | Ilnyckyj et al. |
| 4,029,480 | A | | 6/1977 | Johnston |
| 4,068,054 | A | | 1/1978 | Willcox |
| 4,182,810 | A | | 1/1980 | Willcox |
| 4,252,542 | A | | 2/1981 | Spence |
| 4,259,087 | A | | 3/1981 | Naiman et al. |
| 4,333,741 | A | | 6/1982 | Naiman et al. |
| 4,388,452 | A | | 6/1983 | Naiman et al. |
| 4,416,668 | A | | 11/1983 | Thompson |
| 4,491,651 | A | | 1/1985 | Naiman |
| 4,537,601 | A | | 8/1985 | Naiman |
| 5,071,445 | A | | 12/1991 | Oppenlaender et al. |
| 5,143,594 | A | * | 9/1992 | Stephenson et al. ..... 208/48 AA |
| 5,214,224 | A | | 5/1993 | Comer et al. |
| 5,254,138 | A | | 10/1993 | Kurek |
| 5,672,183 | A | | 9/1997 | Schield |
| 5,863,466 | A | | 1/1999 | Mor |
| 6,180,683 | B1 | | 1/2001 | Miller et al. |
| 6,391,070 | B2 | | 5/2002 | Schield |
| 6,488,724 | B1 | | 12/2002 | Hertel et al. |
| 6,793,695 | B2 | | 9/2004 | Wilkes et al. |
| 2001/0048099 | A1 | * | 12/2001 | Schield ..... 252/500 |
| 2004/0107635 | A1 | * | 6/2004 | Henry, Jr. ..... 44/370 |
| 2005/0183325 | A1 | | 8/2005 | Sutkowski |
| 2005/0203259 | A1 | | 9/2005 | Poliafico et al. |

(Continued)

FOREIGN PATENT DOCUMENTS

| | | |
|---|---|---|
| CN | 1165851 A | 11/1997 |
| DE | 201 10 995 U1 | 1/2002 |

(Continued)

OTHER PUBLICATIONS

Separability Number of Heavy Fuel Oils by Optical Scanning Device D7061, Guide to ASTM Test Methods for the Analysis of Petroleum Products and Lubricants @nd Edition 2007.*

(Continued)

*Primary Examiner* — Cephia D Toomer

(74) *Attorney, Agent, or Firm* — Burns & Levinson, LLP; Janine M. Susan

(57) ABSTRACT

The invention teaches that hydrocarbon compositions may be improved in terms of their stability reserve and in terms of their combustion efficiency, by co-use of a conductivity improver. There is optionally present a combustion improver selected from an iron compound, a manganese compound, a calcium compound and a cerium compound; and/or an organic compound selected from a bicyclic monoterpene, a substituted bicyclic monoterpene, adamantane, a substituted or unsubstituted bicyclic tetraterpene, and propylene carbonate.

16 Claims, No Drawings

(56) References Cited

U.S. PATENT DOCUMENTS

| | | | |
|---|---|---|---|
| 2006/0020065 | A1 | 1/2006 | Krull et al. |
| 2007/0027041 | A1 | 2/2007 | Krull et al. |
| 2007/0220803 | A1 | 9/2007 | Henry, Jr. |

FOREIGN PATENT DOCUMENTS

| | | | |
|---|---|---|---|
| DE | 102 08 326 | A1 | 9/2003 |
| EP | 1 640 438 | A1 | 3/2006 |
| FR | 2376207 | A | 7/1978 |
| GB | 733129 | | 7/1955 |
| GB | 763550 | | 12/1956 |
| GB | 2177719 | A | 1/1987 |
| GB | 2 248 068 | A | 3/1992 |
| GB | 2 254 610 | A | 10/1992 |
| WO | 96/18706 | | 6/1996 |
| WO | 96/18708 | | 6/1996 |
| WO | 03072259 | A | 9/2003 |
| WO | 2005073277 | A1 | 8/2005 |
| WO | 2006047745 | A1 | 5/2006 |
| WO | 2007007191 | A | 1/2007 |
| WO | 2007072005 | A | 6/2007 |

OTHER PUBLICATIONS

Interscience Publishers a Division of John Wiley & Sons, Inc., "Encyclopedia of Polymer Science and Technology, Plastics, Resins, Rubbers, Fibers, Molding to Petroleum Resins," vol. 9, pp. 460-485 (1968).

Gaylord et al., "Communications to the Editor; Donor-Acceptor Complexes in Copolymerization," pp. 442-443, Macromolecules, vol. 2, No. 4.

Ikegami et al., "Polymerization of Coordinated Monomers. III. Copolymerization of Acrylonitrile-Zinc Chloride, Methacrylonitrile-Zinc Chloride or Methyl Methacrylate-Zinc Chloride Complex with Styrene." J. Polymer Sci: Part A-1, vol. 8, pp. 195-208 (1970).

Kirk-Othmer, "Encyclopedia of Chemical Technology," Fourth Edition, vol. 8, pp. 432-445, A Wiley-Interscience Publication, (1993).

International Preliminary Report on Patentability of the International Searching Authority, Data of Issuance, Jan. 26, 2010, from Patent PCT/GB2008/050605, Filed on Jul. 21, 2008.

Written Opinion of the International Searching Authority, from Parent PCT/US2008/050605.

U.K. Intellectual Property Office Search Report under Section 17 dated Mar. 5, 2008 for GB0714175.7.

International Search Report dated Jan. 12, 2009 for PCT/GB08/050605.

* cited by examiner

HYDROCARBON COMPOSITIONS

CROSS-REFERENCE TO RELATED APPLICATIONS

This application is a U.S. national stage application under 35 U.S.C. 371 of co-pending International Application No. PCT/GB08/50605 filed Jul. 21, 2008 and entitled "IMPROVEMENTS IN OR RELATING TO HYDROCARBON COMPOSITIONS", which in turn claims priority to Great Britain Patent Application No. 0714175.7 filed Jul. 20, 2007, and to Great Britain Patent Application No. 0714724.2 filed Jul. 28, 2007, all of which are incorporated by reference herein in their entirety for all purposes."

FIELD OF THE INVENTION

The present invention relates to improvements in hydrocarbon compositions achieved by addition of a conductivity improver.

BACKGROUND OF THE INVENTION

Commonly conductivity/static dissipater additives are utilized to address risks of fires associated with charging, accumulation of charge and discharging in poorly conductive flammable materials.

Movement of liquid gives rise to increased electrostatic charges. Increased electrostatic charges give increased risk of sparking. The risk is greatest where the liquids are of low conductivity; low conductivity liquids can include hydrocarbon fuels, and aliphatic and aromatic solvents, ethers, silicones or esters.

Conductivity improvers (also called antistatic agents or static dissipaters) are used to raise conductivity in many industrial contexts, including manufacture of polymers; in flammable solvents such as styrene, pentane or isooctane; in aluminium foil processing; and in copper extraction.

Use of these additives has greatly reduced the frequency of fires attributed to static discharge ignition.

Asphaltenes are components which are present in hydrocarbons such as crude oils, partially refined oils, fuels, process streams and intermediates. Asphaltenes may separate and cause problems. Separation often occurs on storage or when the hydrocarbons are subjected to change over time, for example temperature change, pressure change or blending with other hydrocarbons. The result may be the formation of sludge, and the problems caused may include difficult or uneven pumping, blocking of ducts and filters and delivery of products of varying composition.

In some cases, separation of asphaltenes may occur during the combustion process, resulting in fouling, for example fouling of surfaces, poor heat transfer or poor combustion, with consequent reductions in fuel economy, reductions in power, increased emissions or increased maintenance costs.

A very large amount of work has been done on chemical additives for inhibiting the separation of asphaltenes from hydrocarbon compositions. Every company active in the fuels sector uses or offers such additives, and the associated patent literature is extensive.

While static dissipaters are used in the industry to address concerns with static discharge ignition, their utility as asphaltene dispersants, as fuel stabilizers or as additives to improve combustion is not foreshadowed in the literature.

It is an object of embodiments of the present invention to provide hydrocarbon compositions with good stability and preferably with good combustion performance.

BRIEF SUMMARY OF THE INVENTION

In accordance with a first aspect of the present invention there is provided the use, in a hydrocarbon composition, of:

(i) a conductivity improver as an anti-separation agent.

An "anti-separation agent" as used in this specification denotes a compound which prevents or inhibits separation, as well as a compound which heals or reduces existing separation in the hydrocarbon composition, thus allowing separated or "split" hydrocarbon compositions to be recovered or improved.

The terms "anti-separation agent" may be substituted by "asphaltene dispersant" at any place in this specification.

The present invention involves in part the discovery that compounds effective as conductivity improvers have a beneficial effect as anti-separation agents in hydrocarbon compositions, e.g. fuels, crude oils, partially refined oils, process streams and intermediates.

The beneficial effect of the conductivity improvers acting as anti-separation agents may be seen in fuel storage, for example by a reduction in problems relating to sludge formation, filter blocking or inhomogeneity. An additional beneficial effect of the conductivity improvers acting as anti-separation agents may be seen on combustion of the fuel for example by increased fuel economy, increased power, reduced smoke, reduced emissions, reduced maintenance costs or increased maintenance intervals.

The discovery that conductivity improvers as a class are effective as anti-separation agents in hydrocarbon compositions is unexpected and important.

In accordance with a second aspect of the present invention there is provided a hydrocarbon composition comprising a conductivity improver in an amount effective to function as an anti-separation agent in the hydrocarbon composition.

In accordance with a third aspect of the present invention there is provided a hydrocarbon composition with enhanced stability reserve and/or improved combustion, comprising a hydrocarbon and (i) a conductivity improver.

In accordance with a fourth aspect of the present invention there is provided a hydrocarbon composition comprising (i) a conductivity improver acting both as a conductivity improver and as an anti-separation agent in the hydrocarbon composition.

In accordance with a fifth aspect of the present invention there is provided a hydrocarbon composition comprising (i) a conductivity improver acting both as a conductivity improver and as an anti-separation agent in the hydrocarbon composition;

and with no dedicated asphaltene dispersant.

In accordance with any of the first, second, third, fourth and fifth aspects, in addition to the conductivity improver acting as an anti-separation agent, there may be present:

(ii) a combustion improver selected from (iia) a metal compound selected from an iron compound, a manganese compound, a calcium compound, a cerium compound and mixtures thereof, and/or (iib) an organic compound selected from a bicyclic monoterpene, a substituted bicyclic monoterpene, adamantane, beta-carotene, propylene carbonate and mixtures thereof.

A "combustion improver" herein is a compound which improves the cleanness or evenness of combustion. Suitably a combustion improver may reduce the carbon content of exhaust fumes, reduce carbon deposition on part of the combustion apparatus or on parts downstream from it, such as exhaust ducting and heat recovery equipment. It may reduce the formation of ash. It may increase fuel economy, increase power, reduce maintenance costs and increase maintenance intervals.

The discovery that conductivity improvers as a class are effective as anti-separation agents in hydrocarbon compositions and can be used to good effect with the defined combustion improvers is unexpected and important.

The invention further involves the finding that the defined compounds are effective as combustion improvers in hydrocarbon compositions also containing conductivity improvers effective as anti-separation agents.

In accordance with any of the first, second, third, fourth aspects, in addition to the conductivity improver acting as an anti-separation agent, there may be present:

(iii) a dedicated asphaltene dispersant.

By "dedicated asphaltene dispersant" we mean a compound known as or marketed as an asphaltene dispersant, and not known as or marketed as a conductivity improver.

In accordance with any of the first, second, third, fourth and fifth aspects, there may also be present one or more of the following:

(iv) a fuel antioxidant;

(v) a cold flow improver;

(vi) a wax anti-setting agent;

(vii) a biofuel instability inhibitor; and (viii) a blended fuel separation inhibitor.

Any feature of any of the aspects of the present invention stated herein may be a feature of any of the other aspects, unless prevented by the context.

Preferred features of the invention will now be described, and are applicable to any of the aspects defined above, unless prevented by the context.

In describing the embodiments of the present invention, specific terminology will be resorted to for the sake of clarity. However, it is not intended that the invention be limited to the specific term so selected, and it is to be understood that each specific term includes all technical equivalents which operate in a similar manner to accomplish a similar purpose. The technical equivalence of the additional terms will be readily recognized by a person who is skilled in the art pertaining to this invention.

DETAILED DESCRIPTION OF THE INVENTION

In this specification "hydrocarbon" or "base hydrocarbon" denotes the hydrocarbon without the conductivity improver; whilst "hydrocarbon composition" denotes that a conductivity improver is present.

When the hydrocarbon is a fuel, it may suitably be a mineral or bio derived fuel, or a blend thereof.

Suitable fuels for use in the present invention include heavy fuel oil, diesel, marine fuel, bunker fuel and heating oil; and in general, middle distillate oil and heavy fuel oil derived from refining petroleum or as a product of, biofuels, and various fuels derived from modern processes such as Fischer-Tropsch processes GTL (gas-to-liquid), CTL (coal-to-liquid), BTL (biomass-to-liquid) and OTL (oil sands-to-liquid), or blends thereof of these fuels.

Petroleum distillate fuel oils can comprise atmospheric or vacuum distillates. The distillate fuel can comprise cracked gas oil or a blend of any proportion of straight run or thermally or catalytically cracked distillates. The distillate fuel in many cases can be subjected to further processing such as hydrogen-treatment or other processes to improve fuel properties.

Middle distillates can be utilized as a fuel for locomotion in motor vehicles, ships and boats; as burner fuel in home heating and power generation and as fuel in multi purpose stationary engines.

Heavy oils are residues or "residual fuels" commonly derived from refinery processing operations such as distillation (atmospheric pressure or reduced pressure), cracking (thermal or catalytic) of petroleum or crude oils. These residual furnace fuels or residual engine fuels (bunker C oils) essentially comprise paraffinic, naphthenic and aromatic hydrocarbons, some containing high molecular weight components.

Heavy oils, in particular in the form of heavy fuel oils (marine fuel oils) and of mixtures of heavy fuel oils and heavy distillates (inter fuel oils) are used in large amounts, primarily as furnace fuel in industrial plants and power stations and as engine fuel for relatively slow-burning internal combustion engines, in particular marine engines.

Engine fuel oils and burner fuel oils generally have flash points greater than 38° C. Middle distillate fuels are higher boiling mixtures of aliphatic, olefinic, and aromatic hydrocarbons and other polar and non-polar compounds having a boiling point up to about 350° C. Middle distillate fuels generally include, but are not limited to, various diesel fuels. Diesel fuels encompass Grades No. 1-Diesel, 2-Diesel, 4-Diesel Grades (light and heavy), Grade 5 (light and heavy), and Grade 6 residual fuels. Middle distillates specifications are described in ASTM D-975, for automotive applications (the entire teaching of which is incorporated herein by reference), and ASTM D-396, for burner applications (the entire teaching of which is incorporated herein by reference).

A biofuel may suitably be bio diesel. Bio diesel as defined by ASTM specification D-6751 (the entire teachings of which are incorporated herein by reference) and EN 14214 are fatty acid mono alkyl esters of vegetable or animal oils. Suitable biofuel may be made from any fat or oil source, including tallow, but is preferably derived from a vegetable oil, for example rapeseed oil, palm oil, palm kernel oil, coconut oil, corn or maize oil, sunflower oil, safflower oil, canola oil, peanut oil, cottonseed oil, jatropha oil (physic nut), used cooking oil or soybean oil. Preferably it is a fatty acid alkyl ester (FAAE). More specifically the biofuel may comprise rapeseed methyl ester (RME) and/or soybean methyl ester (SME) and/or palm oil methyl ester (PME) and/or jatropha oil, methyl ester.

A biofuel may suitably be second generation biodiesel. Second generation biodiesel is derived from hydrogenation of renewable resources such as vegetable oils and animal fats. Second generation biodiesel may be similar in properties and quality to petroleum based fuel oil streams.

The fuels described herein can be blended in any proportions required to meet end user requirements.

The invention as described herein is applicable for any hydrocarbon which contains high molecular weight components.

The high molecular weight components, also termed asphaltenes, are often present in a more or less dispersed form, which gives rise to numerous problems. Thus, asphaltenes and likewise other poorly soluble or insoluble compounds (for example oxygen compounds, nitrogen compounds and sulphur compounds) and products of ageing, in the absence of effective dispersants, separate out from the oil phase, forming an extremely undesirable two-phase system. Additionally, in the presence of moisture, sludge formation can occur which is extremely deleterious to fuel handling and burn properties.

It is therefore advantageous to retard or prevent the separation of asphaltenes and other higher-molecular weight compounds present in the hydrocarbon.

The conductivity improvers according to the invention inhibit the formation of two phases by asphaltenes and other higher-molecular weight fractions. Thus heavy oils containing these additives are resistant to sludge formation and the impairment of combustion attributes.

In the present embodiment, Static Dissipaters (SD), Conductivity Improver (CI), or Anti Stats (AS) to be utilized as anti-separation agent in a hydrocarbon composition are defined as any chemical species which are either present or added to hydrocarbon fluids which increases the conductivity or the rate of charge dissipation in such hydrocarbon fluids.

'Hydrocarbon conductivity' as stated herein is measured by the procedures given in ASTM D 2624.

Conductivity Improver (i)

It is believed (without our being limited hereto) that a preferred conductivity improver for use in this invention is one which when added to a paraffinic reference hydrocarbon at a treat rate of 100 mg/kg gives a conductivity of at least 30 pS/m, when the solution is tested according to ASTM 2624. A suitable paraffinic reference hydrocarbon is ISOPAR M (trade mark), commercially available from Exxon Mobil Corporation.

Preferably a conductivity of at least 30 pS/m, is achieved in this reference hydrocarbon at a treat rate of less than 50 mg/kg, preferably less than 10 mg/kg, for example less than 5 mg/kg.

Suitable static dissipaters/conductivity improver additives exist and can be utilized pursuant to this invention have components derived from chemical families that include: aliphatic amines-fluorinated polyolefins (U.S. Pat. No. 3,652,238); chromium salts and amine phosphates (U.S. Pat. No. 3,758,283); alpha-olefin-sulfone copolymer class—polysulphone and quaternary ammonium salt (U.S. Pat. No. 3,811,848); polysulphone and quaternary ammonium salt amine/epichlorhydrin adduct dinonylnaphthylsulphonic acid (U.S. Pat. No. 3,917,466); copolymer of an alkyl vinyl monomer and a cationic vinyl monomer (U.S. Pat. No. 5,672,183); alpha-olefin-maleic anhydride copolymer class (U.S. Pat. Nos. 3,677,725 & 4,416,668); methyl vinyl ether-maleic anhydride copolymers and amines (U.S. Pat. No. 3,578,421); alpha-olefin-acrylonitrile (U.S. Pat. Nos. 4,333,741 & 4,388,452); alpha-olefin-acrylonitrile copolymers and polymeric polyamines (U.S. Pat. No. 4,259,087); copolymer of an alkylvinyl monomer and a cationic vinyl monomer and polysulfone (U.S. Pat. No. 6,391,070); an ethoxylated quaternary ammonium compound (U.S. Pat. No. 5,863,466); hydrocarbyl monoamine or hydrocarbyl-substituted polyalkyleneamine (U.S. Pat. No. 6,793,695); acrylic-type ester-acrylonitrile copolymer and polymeric polyamine (U.S. Pat. Nos. 4,537,601 & 4,491,651); and diamine succinamide reacted with an adduct of a ketone and $SO_2$ (β-sultone chemistry) (U.S. Pat. No. 4,252,542). The entire teachings of these patents are incorporated herein by reference.

In certain preferred embodiments the conductivity improver comprises a polysulfone component.

In certain preferred embodiments the conductivity improver comprises a polymeric nitrogen-containing conductivity improver.

In certain preferred embodiments the conductivity improver comprises a polyamine compound.

In certain preferred embodiments the conductivity improver is a composition comprising both a polyamine component and a polysulfone component.

A polyamine component in a composition in the present invention is preferably the reaction product of epichlorohydrin with an aliphatic primary monoamine or N-aliphatic hydrocarbyl alkylene diamine.

Preferred diamines are alkyl or alkenyl diamines of the general formula:

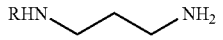

wherein R is preferably selected from an alkyl or alkenyl straight chain group of mainly $C_8$ to $C_{18}$ (coco propylene diamine); a straight chain alkyl group of mainly $C_{16}$ to $C_{22}$ ($C_{16-22}$ alkylpropylene diamine); a straight chain alkyl group of mainly $C_{16}$ to $C_{18}$ (tallow propylene diamine). Most preferably R represents an alkyl or alkenyl straight chain of mainly $C_{18}$ and the amine is oleyl (vegetable oil) propylene diamine.

A polysulfone component in a composition in the present invention is suitably a copolymer of one or more alkenes and sulfur dioxide.

A polysulfone used in this invention is readily prepared by the methods known in the art (see for example, Encyclopaedia of Polymer Science and Technology Vol. 9, Interscience Publishers, page 460 et seq.).

A polysulfone copolymer used in this invention is suitably of the structure —R—$SO_2$—R—$SO_2$—R—$SO_2$—R— where R represents an alkene-derived moiety.

The weight average molecular weight of a polysulfone used herein is preferably in the range from about 1,000 to 1,500,000, with the preferred range being from about 10,000 to 990,000, and the most preferred molecular weights being in the range from about 100,000 to 500,000. The molecular weight of a polysulfone used herein may be determined by any suitable method, for example by light scattering or by determination of the inherent viscosity as described in U.S. Pat. No. 3,917,466 or by gel permeation chromatography.

In some embodiments, a polysulfone-polyamine composition for use as a conductivity improver in the present invention may comprise further components, for example a soluble sulfonic acid, a viscosity modifier or a solvent. A preferred solvent is an aromatic solvent, for example benzene optionally substituted by from 1 to 3 C(1-4) alkyl groups.

A preferred polysulfone-polyamine composition for use as a conductivity improver in the present invention further comprises a strong acid, preferably an oil-soluble sulfonic acid.

When present, an oil soluble sulphonic acid is preferably present in an amount of at least 1 wt %, preferably at least 2 wt %, more preferably at least 3 wt % and most preferably at least 5 wt %. The oil soluble sulphonic acid may be present in an amount of up to 90 wt %, suitably up to 70 wt %, preferably up to 50 wt % and most preferably up to 30 wt %.

Preferred sulfonic acids include dodecyl benzene sulfonic acid and dinonylnapthalene sulphonic acid.

In some preferred embodiments, a polysulfone-polyamine composition used in the present invention further comprises a quaternary ammonium compound, preferably of the formula:

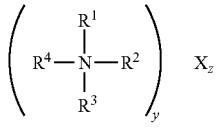

wherein $R^1$ and $R^2$ are the same or different alkyl groups having 1 to 22 carbon atoms; $R^3$ is selected from the group consisting of alkyl groups of 1 to 22 carbon atoms and —$(CH_2CR^5HO)_nH$ wherein $R^5$ is hydrogen or methyl and n is 1 to 20;

and $R^4$ is selected from (a) an alkyl group having 1 to 22 carbon atoms, (b) an arylalkyl group having 7 to 22 atoms, (c) —$(CH_2CR_5HO)_nH$, (d) a group of formula:

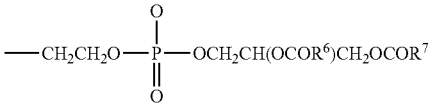

wherein $R^6$ and $R^7$ are the same or different alkyl groups having 11 to 19 carbon atoms, and (e) $R^8CO_2$ wherein $R^8$ is a hydrocarbyl group having 1 to 17 carbon atoms, with the proviso that when $R^1$, $R^2$, $R^3$ and $R^4$ are all alkyl groups, at least one of them is an alkyl group having at least 8 carbon atoms;

X is an anion; z is 0 or 1, Z is 0 when $R^4$ is (d) or (e) and; y is at least 1, y is equal to the valence of anion when z is 1.

In another embodiment, the conductivity improver may contain an acrylonitrile copolymer, preferably a copolymer of an alpha olefin and acrylonitrile, and/or a polyamine. In such an embodiment the olefin portion of the copolymer is suitably an olefin of at least 6 carbon atoms to insure that the copolymer is sufficiently soluble in hydrocarbons. For practical and economic reasons, the olefin used for the preparation of the copolymer should have less than about 28 carbon atoms. The preferred olefins will have from about 10 to 20 carbon atoms The copolymer may be prepared by a variety of known methods such as those described by Gaylord et al, Macromolecules, Vol. 2, page 442, et seq. 1969, and Ikegami et al., Journal of Polymer Science, Part A-5, Vol. 8, pages 195-208 (1970).

A wide variety of polymeric polyamines can be employed in conjunction with alpha-olefin-acrylonitrile copolymers to yield suitable compositions which can be used in this embodiment. The polymeric polyamine should be soluble in the system in which it is employed and be effective as an antistatic agent in combination with said alpha-olefin-acrylonitrile copolymer. Typical polyamines are as described in relation to the previous embodiment (concerning polysulfone-polyamine compositions).

In another embodiment, the conductivity improver may be a copolymer of alkylvinylmonomers and cationic vinyl monomers.

In such an embodiment the conductivity improver is a hydrocarbon-soluble copolymer of an alkylvinyl monomer and a cationic vinyl monomer, especially a cationic quaternary ammonium vinyl monomer, wherein the alkylvinyl monomer unit to cationic vinyl monomer unit ratio is from about 1:1 to about 10:1 and the copolymer has an average molecular weight of from about 800 to 1,000,000.

In another embodiment, the conductivity improver may be an olefin maleic anhydride copolymer.

In such an embodiment, the copolymers consisting of maleic anhydride and an alpha olefin are selected from the group consisting of (I) maleic anhydride and a 1-olefin or an alkylvinylether and (2) the alkyl esters, carboxymethyl amides or carboxymethyl esters of the aforementioned copolymers.

Exemplary of such conductivity improvers are copolymers of 1-octadecene-maleic anhydride, 1-octadecene-maleic acid, carboxymethyl amide of 1-octadecene-maleic anhydride, carboxymethyl ester of 1-octadecene-maleic anhydride, copolymers of maleic anhydride and 1-olefins having from about 22 to about 28 carbon atoms, copolymers of maleic anhydride and 1-olefins having at least 30 carbon atoms, diisodecylesters of 1-octadecene-maleic anhydride copolymers, 2-methylpentyl ester of 1-octadecene-maleic anhydride copolymer, copolymers of n-hexadecylvinylether and maleic anhydride, copolymers of isooctylvinylether and maleic anhydride, copolymers of; dodecylvinylether and maleic anhydride and copolymers of octadecylvinylether and maleic anhydride. It will be understood, of course, that other copolymers of the aforementioned representative types may also be successfully used the present invention for their beneficial conductivity-improving effect.

In another embodiment, a conductivity improver used herein may be a liquid hydrocarbon composition containing reaction products of an amine and methyl vinyl ether-maleic anhydride copolymer.

In such an embodiment, the conductivity improver may comprise the reaction product of any amine and a methyl vinyl ether-maleic anhydride copolymer. Particularly preferred, and representative of such amines are: primary amines having a tertiary carbon atom attached to an amino group and continuing from about 12 to about 15 carbon atoms per amine molecule (often referred to in the literature as Primene 81 R) or primary amines having a tertiary carbon atom attached to an amino group and containing from about 18 to about 24 carbon atoms per amine molecule (often referred to in the literature as Primene JMT); fatty amines, as exemplified by primary oleylamine, di-secondary coco-amine and tri-caprylyl amine; alkylaryl amines, as exemplified by phenylstearylamine; and complexed fatty acid fatty diamines, as exemplified by the condensation reaction product of 1 mol of oleyldiamine and 1 mol of a tall oil fatty acid. It will be understood, of course, that the reaction products of other amines and the aforementioned methyl vinyl ether-maleic anhydride copolymer may also be successfully used in the present invention for their beneficial conductivity-improving effect.

In another embodiment, the conductivity improvers may be additives consisting essentially of a trivalent chromium salt of an organic phosphate, a nitrogen containing copolymer and an amine neutralized alkyl phosphate.

In further embodiments, the additive compositions of previous embodiments or components of those compositions may be combined.

For example compositions defined in the class of alkylvinylmonomers and cationic vinyl monomers above can be combined with one or more components from the class of compositions containing a polysulfone component and/or a polyamine component.

In a preferred embodiment, the copolymer has an alkylvinyl monomer unit to cationic vinyl monomer unit ratio of from about 1:1 to about 10:1, the copolymer having an average molecular weight of from about 800 to about 1,000,000. In another embodiment, the cationic vinyl monomer is a cationic quaternary ammonium vinyl monomer, and in a preferred embodiment is a cationic quaternary ammonium acrylate monomer or a cationic quaternary ammonium methacrylate monomer.

In a preferred embodiment, the hydrocarbon soluble polysulfone copolymer of at least one olefin and sulfur dioxide includes about 50 mol percent of units from sulfur dioxide, about 40 to 50 mol percent of units derived from one or more 1-alkenes each having from about 6 to 24 carbon atoms, and from about 0 to 10 mol percent of units derived from an olefinic compound having the formula ACH—CHB wherein A is a group having the formula —(CxH2x)-COOH wherein x is from 0 to about 17, and B is hydrogen or carboxyl, with the proviso that when B is carboxyl, x is 0, and wherein A and B together can be a dicarboxylic anhydride group. The molecular weight of the polysulfone copolymer may range from about 10,000 to about 500,000, in one non-limiting embodiment, and preferably from about 200,000 to about 300,000.

An optional component is a polymeric polyamine preferably having the formula

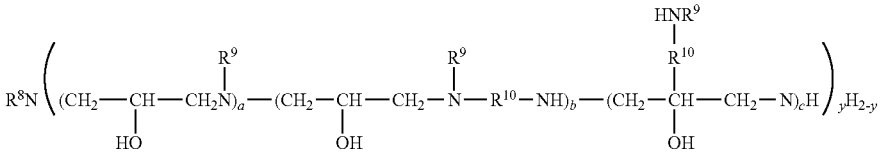

where $R^9$ is an aliphatic hydrocarbyl group of 8 to 24 carbon atoms, $R^{10}$ is an alkylene group of 2 to 6 carbon atoms, $R^8$ is $R^9$, or an n-aliphatic hydrocarbyl alkylene group of the formula $R^9NHR^{10}$, a is an integer of 0 to 20, b is an integer of 0 to 20, c is an integer of 0 to 20, and y is an integer of 1 to 2, with the proviso that when $R^8$ is $R^9$ then a is an integer of 2 to 20 and b=c=0, and when R is $R^9NH—R^{10}$ then a is 0 and b+c is an integer of 2 to 20.

An arylsulfonic acid can also be present.

The weight ratio of the copolymer of an alkylvinyl monomer and a cationic vinyl monomer to the polysulfone copolymer ranges from about 1/9 to about 9/1. A preferred range is from about 1/1 to about 7/3. Another non-limiting preferred range of weight ratio of the two copolymers is from about 6/4 to about 4/6, more preferably about 1/2 to about 2/1 or even about 1/1. The polysulfone copolymer and the polymeric polyamine may present in a weight ratio of about 100/1 to about 1/100; preferably 50/1 to 1/1; and most preferably from about 20:1 to 1:1. The arylsulfonic acid, if present with the polymeric polyamine, is present in approximately a 1/1 mole ratio with the polyamine to form the salt.

Preferably the conductivity improver (i) is present in an amount of at least 1 mg/kg in the hydrocarbon composition, preferably at least 5 mg/kg, preferably at least 10 mg/kg, preferably at least 20 mg/kg, preferably at least 40 mg/kg, preferably at least 50 mg/kg, preferably at least 60 mg/kg, more preferably at least 70 mg/kg, and most preferably at least 80 mg/kg.

Preferably the conductivity improver (i) is present in an amount of up to 100,000 mg/kg in the hydrocarbon composition, preferably up to 10,000 mg/kg, preferably up to 5,000 mg/kg, preferably up to 2,000 mg/kg, preferably up to 1,000 mg/kg, more preferably up to 400 mg/kg, and most preferably up to 200 mg/kg.

The values stated for conductivity improver refer to concentration of active conductivity improving components. The same applies to definitions of concentrations of other components mentioned herein.

Combustion Improver: Metal Compound (iia)

The metal compound (iia), when present, is selected from an iron compound, a manganese compound, a calcium compound, a cerium compound, and mixtures thereof.

It is important that a metal compound for use in the invention is fuel soluble or dispersible and preferably fuel stable. The precise nature of the metal containing compounds is less important.

Preferably a manganese compound, when present, is selected from a manganese carbonyl compound, manganese (II) 2-ethylhexanoate, manganese naphthenate, and mixtures thereof.

The most desirable general type of manganese carbonyl compounds utilised in accordance with this invention comprise organomanganese polycarbonyl compounds. For best results, use should be made of a cyclopentadienyl manganese tricarbonyl compound of the type described in U.S. Pat. Nos. 2,818,417 and 3,127,351.

In one aspect, the manganese compound is an organomanganese compound.

A preferred organomanganese compound is cyclopentadienyl manganese tricarbonyl. Particularly preferred for use in the practice of this invention is methylcyclopentadienyl manganese tricarbonyl.

Preferably a calcium compound, when present, is selected from calcium 2-ethylhexanoate, calcium naphthenate, calcium sulphonates, calcium carboxylates (including calcium soaps including neutral calcium soaps and overbased calcium soaps); and mixtures thereof.

Preferably the calcium compound is calcium sulfonate.

Other suitable calcium compounds are disclosed in GB2248068 and GB2254610 and are discussed therein.

Preferably a cerium compound, when present, is selected from cerium (III) 2-ethylhexanoate, cerium sulphonates, cerium carboxylates (including cerium soaps including neutral cerium soaps and overbased cerium soaps); and mixtures thereof.

When an iron compound is present there may be provided a single iron compound as metal compound, or a mixture of iron compounds.

Preferably the iron compound, when present, is an iron complex selected from bis-cyclopentadienyl iron; substituted bis-cyclopentadienyl iron; iron carboxylates (including iron soaps including overbased iron soaps, such as iron tallate, iron octoate and iron neodecanoate); and mixtures thereof.

Preferably the iron compound is an iron complex selected from bis-cyclopentadienyl iron, substituted bis-cyclopentadienyl iron and mixtures thereof.

In one aspect, the iron compound is an iron complex selected from bis-cyclopentadienyl iron, adamantyl bis-cyclopentadienyl iron, bis(dicyclopentadienyl-iron)dicarbonyl, iron tallate, iron neo ecanoate and iron octoate; and mixtures thereof.

Suitable alkyl-substituted-dicyclopentadienyl iron complexes are cyclopentadienyl-(methylcyclopentadienyl) iron, cyclopentadienyl(ethyl-cyclopentadienyl) iron, bis-(methylcyclopentadienyl) iron, bis-(ethylcyclopentadienyl) iron, bis-(1,2-dimethyl-cyclopentadienyl) iron, and bis-(1-methyl-3-ethylcyclo-pentadienyl) iron. These iron complexes can be prepared by the processes taught in U.S. Pat. No. 2,680,756, U.S. Pat. No. 2,804,468, GB-A-0733129 and GB-A-0763550. Another volatile iron complex is iron pentacarbonyl.

A preferred iron complex is ferrocene (i.e. bis-cyclopentadienyl iron).

Instead of ferrocene, equivalent quantities of other organic iron compounds which are soluble in hydrocarbon mixtures can be used in respect of the iron content. This applies to all statements and descriptions which follow. Dicyclopentadienyl iron has proven to be particularly suitable. Ferrocene derivatives can be used at least in part instead of ferrocene. Ferrocene derivatives are compounds where, starting from a basic ferrocene molecule, further substituents are found on one or both of the cyclopentadienyl rings. Examples could be ethylferrocene, butylferrocene, acetylferrocene and 2,2-bis-ethylferrocenylpropane. Geminal bisferrocenylalkanes are also suitable, as described, for example, in DE 201 10 995 and DE 102 08 326.

As a result of a combination of their solubility, stability, high iron content and, above all, volatility, the substituted ferrocenes are preferred iron compounds for use in the invention. Ferrocene itself is an especially preferred iron compound on this basis. Ferrocene of suitable purity is sold in a range of useful forms as PLUTOcen® and as solutions, Satacen® both by Innospec Limited.

The iron compounds for use in the invention need not feature iron-carbon bonds in order to be fuel compatible and stable. Salts may be used; these may be neutral or overbased. Thus, for example, overbased soaps including iron stearate, iron oleate and iron naphthenate may be used. Methods for the preparation of metal soaps are described in The Kirk-Othmer Encyclopaedia of Chemical Technology, 4th Ed, Vol. 8:432-445, John Wiley & Sons, 1993. Suitable stoichiometric, or neutral, iron carboxylates for use in the invention include the so-called 'drier-iron' species, such as iron tris(2-ethylhexanoate) [19583-54-1].

Preferably, the metal compound is selected from one or more iron compounds, methylcyclopentadienyl manganese tricarbonyl, manganese(II) 2-ethylhexanoate, manganese naphthenate, calcium 2-ethylhexanoate, calcium naphthenate, calcium sulfonate, cerium(III) 2-ethylhexanoate, cerium sulfonate, and mixtures thereof.

A preferred metal compound is an iron compound, especially ferrocene.

Preferably the metal compound (iia) is present in an amount of at least 3 mg/kg, preferably at least 5 mg/kg, preferably at least 10 mg/kg, preferably at least 15 mg/kg and preferably at least 20 mg/kg, in the hydrocarbon composition.

Preferably metal compound (iia) is present in an amount of up to 1000 mg/kg, preferably up to 400 mg/kg, preferably up to 200 mg/kg, preferably up to 100 mg/kg, and preferably up to 50 mg/kg, in the hydrocarbon composition.

Preferably the metal compound (iia) is present in an amount sufficient to provide at least 0.1 mg/kg of the metal, preferably at least 2 mg/mg, preferably at least 3 mg/kg, and preferably at least 6 mg/kg, in the hydrocarbon composition.

Preferably the metal compound (iia) is present in an amount of up to provide 350 mg/kg of the metal, preferably up to 140 mg/kg, preferably up to 60 mg/kg, preferably up to 30 mg/kg, and preferably up to 15 mg/kg, in the hydrocarbon composition.

If, for example, the metal compound (iia) is ferrocene, then 30 mg/kg of ferrocene provides about 10 mg/kg of the metal (iron), in the hydrocarbon composition.

Combustion Improver: Organic Compound (iib)

Preferably, the organic compound (iib), when present, is selected from a bicyclic monoterpene, substituted bicyclic monoterpene and mixtures thereof.

Suitable substituted bicyclic monoterpenes are those wherein the substituents can be, for example, one or more of aldehyde, ketone, alcohol, acetate and ether functional groups.

Preferably, the organic compound is a bicyclic monoterpene or substituted bicyclic monoterpene selected from camphor, camphene, isobornyl acetate, dipropyleneglycol-isobornyl ether and mixtures thereof.

In one aspect, the organic compound is selected from camphor, camphene, isobornyl acetate, dipropyleneglycol-isobornyl ether, adamantane, beta-carotene, propylene carbonate and mixtures thereof.

Preferably, the organic compound is camphor. Camphor has the systematic name 1,7,7-trimethylbicyclo[2.2.1]heptan-2-one. Camphor has the following structure:

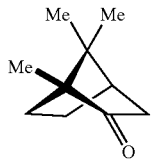

The organic compound (iib) may suitably comprise a substituted or unsubstituted bicyclic tetraterpene, for example beta-carotene.

Preferably the organic compound (iib), when present, is present in an amount of at least 1 mg/kg, preferably at least 3 mg/kg; preferably at least 5 mg/kg, preferably at least 8 mg/kg, and preferably at least 12 mg/kg, in the hydrocarbon composition.

Preferably the organic compound (iib), when present, is present in an amount of up to 600 mg/kg; preferably up to 200 mg/kg, preferably up to 100 mg/kg; preferably up to 50 mg/kg, and preferably up to 25 mg/kg, in the hydrocarbon composition.

Dedicated Asphaltene Dispersants (iii)

Hydrocarbon separability can also be affected by further materials which commonly function as asphaltene dispersants. These materials, designated herein as (iii), "dedicated asphaltene dispersants", can be present in any aspect of the present invention. By "dedicated asphaltene dispersant" we mean a compound known as or marketed as an asphaltene dispersant, and not known as or marketed as a conductivity improver.

"Dedicated asphaltene dispersants" can include alkoxylated fatty amines or derivatives thereof; alkoxylated polyamines; alkane sulphonic acids; aryl sulphonic acids; sarcosinates; ether carboxylic acids; phosphoric acid esters; carboxylic acids and derivatives thereof; alkylphenol-aldehyde resins; hydrophilic-lipophilic vinylic polymers; alkyl substituted phenol polyethylene polyamine formaldehyde resins; alkyl aryl compounds; alkoxylated amines and alcohols; imines; amides; zwitterionic compounds; fatty acid esters; lecithin and derivatives thereof; and derivatives of succinic anhydride and succinamide.

Preferred dedicated asphaltene dispersants for use in the present invention are molecules comprising alkyl groups, preferably alkyl groups having at least 12 carbon atoms and polar functional groups selected from, for example, sulphonic acid groups, phosphonic acid groups, carboxylic acid groups, amines, amides, imides, alcohols and esters. Compounds including aromatic moieties are also suitable. Regions of the molecule may, for example, be linked by a polyalkoxylene unit, carbonate groups, imine or amide groups.

Suitable compounds are polymeric or oligomeric compounds. Most suitable are polymeric or oligomeric compounds including a hydrophobic functionality and a hydrophilic functionality.

Suitable alkoxylated fatty amines include those of formula:

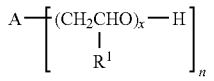

where n is an integer from 1 to 4, wherein when n is 1, A has structure (a); when n is 2, A has structure (b); when n is 3, A has structure (c) and when n is 4, A has structure (d):

(a)

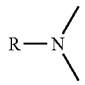

(b)

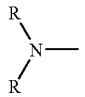

(c)

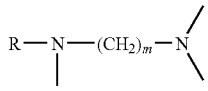

(d)

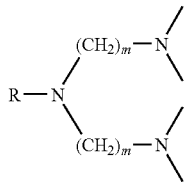

and wherein R is a $C_6$ to $C_{22}$ alkyl, preferably a $C_6$ to $C_{18}$ alkyl; m is 2, 3 or 4, preferably 2 or 3; x is a number from 5 to 120, preferably from 10 to 80; and $R^1$ may be H, $CH_3$ or both. When both, the oxyalkylene moieties may be arranged randomly or in blocks.

Suitable sulphonic acid derivatives for use as dedicated asphaltene dispersants herein include alkyl sulphonic acids, aryl sulphonic acids, alkyl aryl sulphonic acids, and derivatives thereof, for example those of formula:

$$RSO_3X$$

wherein X is hydrogen or an alkali metal ion; and R is an optionally substituted, linear or branched, alkyl group having 2 to 40 carbon atoms, preferably 5 to 30 carbon atoms; or an optionally substituted aryl group having up to 30 carbon atoms. Preferred aryl groups are those based on napthalene or especially, benzene.

In preferred embodiments R is an alkyl aryl sulphonic acid in which R is $R^1Ar^1$ wherein $R^1$ is an alkyl group having 12 to 32, especially 12 to 24 carbon atoms and $Ar^1$ is a disubstituted aryl moiety, most preferably $C_6H_4$.

Also preferred are secondary alkane sulphonic acids in which R has 8 to 22, preferably 11 to 18 carbon atoms.

Preferred sarcosinates for use as dedicated asphaltene dispersants in the present invention include those of formula:

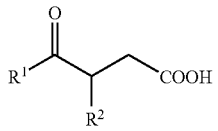

wherein $R^1$ and $R^2$ are independently selected from optionally substituted alkyl groups having 1 to 30 carbon atoms. Preferably $R^1$ is a $C_7$ to $C_2$, alkyl or alkenyl and $R^2$ is H, methyl, butyl, isobutyl or a $C_{11}$ to $C_{22}$ alkyl.

Suitable ether carboxylic acids for use as dedicated asphaltene dispersants in the present invention include compounds in which an optionally substituted hydrocarbyl moiety is linked to a carboxylic acid residue by one or more alkoxy groups. Examples of preferred ether carboxylic compounds include compounds of formula:

$$RO(CH_2CHR^1O)_x(CH_2CHR^2O)_yCH_2COOH$$

wherein R is $C_2$ to $C_{30}$, preferably C6 to C22, preferably C9 to C18 alkyl or alkenyl, or C2 to C30, preferably C6 to C20 alkylaryl; R1 and R2 are independently H or CH3, preferably H; and x and y are independently 0 to 30, preferably 0 to 20. Preferably the sum of a and y is between 1 and 20, preferably between 1.5 and 8.

Phosphoric acid esters suitable for use as dedicated asphaltene dispersants in the present invention include monoesters, diesters and triesters prepared from the reaction of phosphoric acid with fatty alcohols, alkoxylated fatty alcohols and alkoxylated alkylaryl alcohols. Preferred phosphoric acid esters include the monoesters and diesters of formula:

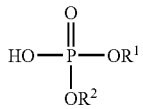

wherein $R^1$ is selected from H, a $C_1$ to $C_{30}$, preferably a $C_1$ to $C_{22}$ alkyl group, a $C_2$ to $C_{30}$, preferably $C_2$ to $C_{22}$ alkenyl group, a $C_6$ to $C_{30}$, preferably $C_6$ to $C_{18}$ alkylaryl group or $(CH_2CHR^3O)_nR^4$, where $R^3$ is H or $CH_3$, preferably H, $R^4$ is H, a $C_1$ to $C_{30}$, preferably a $C_1$ to $C_{22}$ alkyl group, a $C_2$ to $C_{30}$, preferably $C_2$ to $C_{22}$ alkenyl group, or a $C_6$ to $C_{30}$, preferably $C_6$ to $C_{18}$ alkyl alkylaryl group, and n is an integer from 1 to 30, preferably 1 to 20, more preferably from 1 to 10; and $R^2$ is selected from a $C_1$ to $C_{30}$, preferably a $C_1$ to $C_{22}$ alkyl group, a $C_2$ to $C_{30}$, preferably $C_2$ to $C_{22}$ alkenyl group, a $C_6$ to $C_{30}$, preferably $C_6$ to $C_{18}$ alkylaryl group or $(CH_2CHR^5O)_mR^6$, where $R^5$ is H or $CH_3$, preferably H, $R^6$ is H, a $C_1$ to $C_{30}$, preferably a $C_1$ to $C_{22}$ alkyl group, a $C_2$ to $C_{30}$, preferably $C_2$ to $C_{22}$ alkenyl group, or a $C_6$ to $C_{30}$, preferably $C_6$ to $C_{18}$ alkyl alkylaryl group, and m is an integer from 1 to 30, preferably 1 to 20, more preferably from 1 to 10. Preferred alkylaryl substituents when present are those based on benzene or naphthalene and alkyl and alkenyl substituents may be branched or linear and preferably have 10 to 20, especially 12 to 18 carbon atoms.

Suitable carboxylic acids for use as dedicated asphaltene dispersants herein are those having more than 4 carbon atoms, especially those having 8 to 22 and in particular 12 to 18 carbon atoms.

Suitable hydrophilic-lipophilic vinylic polymers for use as dedicated asphaltene dispersants herein are those of formula:

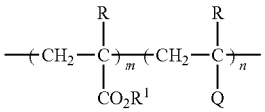

wherein each R is independently selected from H and $CH_3$; each $R^1$ is an alkyl, alkenyl, aryl, alkylaryl or arylalkyl group having 2 to 30, preferably 4 to 22 carbon atoms; and each Q is selected from $CO_2M$ and $CONHR^2$ wherein M may be H, a group I or group II metal ion, ammonium or amine cation, hydroxylethyl, hydroxylpropyl or $—(CH_2CHRO)_xH$ and each $R^2$ is $—(CH_2CHRO)_xH$ or $—(CH_2)_{1-3}COOM$ wherein x is 1 to 30, preferably 1 to 20; and n is an integer selected such that the polymer has a weight average molecular weight of between 5000 and 250000.

Suitable alkyl substituted phenol polyethylene polyamine formaldehyde resins for use as dedicated asphaltene dispersants herein include those prepared by the base catalyzed reaction of a monosubstituted alkylphenol having an alkyl substituent containing from about 4 to 24 carbon atoms, which alkyl substituent may be a linear or branched alkyl group and a polyethylene polyamine represented by the formula $H_2N(CH_2CH_2NH)_nH$ where n is an integer of from 1 to 5; and formaldehyde; in a mole ratio of alkylphenol to polyethylenepolyamine of from 5:1 to 3:1, and a mole ratio of alkylphenol to formaldehyde of from about 2:1 to 1:2, said resin having a weight average molecular weight of from about 1,000 to about 20,000.

Suitable substituted aromatic compounds for use as dedicated asphaltene dispersants herein include those of formula:

$$X—(R)_n$$

wherein n is from 1 to the valency of X, X is an optionally substituted carbocyclic ring, preferably derived from benzene, naphthalene or anthracene and R is and aliphatic chain preferably and alkyl group having 10 to 25, preferably 12 to 20 carbon atoms.

Suitable dedicated asphaltene dispersants may include condensation products of fatty acids having from 12 to 24 carbon atoms and polyamines of the general formula $H_2N—[(CH_2)_n—NH]_m—R^1$ in which $R^1$ is hydrogen, a methyl, ethyl, hydroxyethyl or a $—(CH_2)_n—NH—R^2$ group, $R^2$ is hydrogen, a methyl, ethyl or hydroxyethyl group, and n is a number between 1 and 4, and m stands for numbers from 1 to 6.

Suitable dedicated asphaltene dispersants may include alkoxylated fatty amines and alkoxylated fatty alcohols. Preferred examples of these include alkoxylated (especially ethoxylated) fatty alcohols having from 8 to 22 carbon atoms and from 10 to 60 mol of alkoxide per mole of fatty alcohol and ethoxylated alkylamines having alkyl radicals of from 12 to 22 carbon atoms and from 10 to 30 mol of ethylene oxide per mole of alkylamine.

Suitable dedicated asphaltene dispersants may include imine, thiocarbonyl, or carbonyl containing compounds of formula:

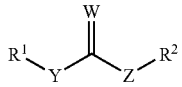

which has at least 8, preferably at least 10 carbon atoms; wherein Y is $C_1$-$C_3$ difunctional alkyl, O, S, $NR^3$ or is absent; Z is hydrogen, O, S, $NR^4$ or is absent; W is O, S, or $NR^5$; $R^1$, $R^2$, $R^3$, $R^4$ and $R^5$ independently are hydrogen or organic functional groups; and at least one of Y, $R^1$, $R^2$, $R^3$, $R^4$ and $R^5$ is substituted by at least one polar group two to ten chemical bonds from the carbonyl, thiocarbonyl or imine carbon. Preferred polar groups are hydroxyl and hydroxylamino. Preferred organic functional groups are optionally substituted alkyl, heteroalkyl, aryl, aralkyl, heterocyclic or heterocyclic-alkyl groups. In a preferred embodiment, at least one of the organic functional groups is a $C_2$-$C_{22}$ alkyl or heteroalkyl group, more preferably a $C_7$-$C_{22}$ alkyl or heteroalkyl group, more preferably a $C_9$-$C_{22}$ alkyl or heteroalkyl group, and most preferably, a $C_{15}$-$C_{22}$ alkyl group. Preferably, the alkyl or heteroalkyl groups are unsubstituted.

Suitable dedicated asphaltene dispersants may include the reaction products of imines and organic acids. Examples of preferred such dedicated asphaltene dispersants are salts of carboxylic, phosphonic or sulfonic acid, especially one having only a single acidic group. Preferably the salt has a polar group located two to ten chemical bonds from either a carbonyl carbon of a carboxylate group, a phosphorus atom of a phosphonate group or a sulfur atom of a sulfonate group; or a nitrogen atom of a protonated imine group. The polar group is preferably selected from hydroxy, oxime, nitro, ester, amide or alkyl amide.

Suitable dedicated asphaltene dispersants may include the reaction product of an amine and an organic acid. Examples of preferred asphaltene dispersants are salts a carboxylic, phosphonic or sulfonic acid. Preferably the salt has a polar group located two to eight chemical bonds from either a carbonyl carbon of a carboxylate group, a phosphorus atom of a phosphonate group or a sulfur atom of a sulfonate group; or a nitrogen atom of a protonated amine group. The polar group is preferably selected from hydroxyl and oxime.

Suitable dedicated asphaltene dispersants may include compounds of formula:

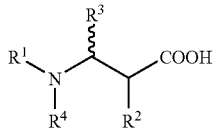

or a zwitterionic salt thereof; wherein $R^1$ is $C_{10}$-$C_{22}$ alkyl or aralkyl; $R^2$ and $R^3$ independently are hydrogen or $C_1$-$C_4$ alkyl; $R^4$ is hydrogen, $C_1$-$C_{22}$ alkyl, $C_7$-$C_{22}$ arylalkyl, or $—CH(R^5)CH(R^6)COOH$, wherein $R^5$ and $R^6$ independently are hydrogen or $C_1$-$C_4$ alkyl.

Alkylene oxide phosphite asphaltenates (or phosphoalkoxylated asphaltenes), as described in U.S. Pat. No. 5,207,891, may also be used as dedicated asphaltene dispersants herein.

Suitable dedicated asphaltene dispersants may include a polymer comprising structural units derived from monomers which are at least one of (A) at least one ethylenically unsaturated alcohol, carboxylic acid or ester, (B) an ethylenically unsaturated carboxylic ester with a polar group in the ester, and (C) an ethylenically unsaturated carboxylic amide, wherein at least one of said structural units contains at least one pendant ring group. Alternatively, the pendant ring group may be introduced into the polymer by transesterification. Alkyl methacrylates are suitable, for example $C_6$-$C_{22}$ alkyl methacrylates. Two examples of the structural unit are p-nonylphenyl methacrylate and p-dodecylphenyl methacrylate.

Suitable dedicated asphaltene dispersants may include esters of a $C_6$-$C_{33}$ fatty acid, preferably of a $C_{10}$-$C_{22}$ fatty acid. The fatty acid may be saturated (for example lauric, stearic) or unsaturated (for example oleic).

Suitable esters may comprise compounds formed by the reaction of a first compound having 1 to 4, preferably 1 to 3 acid functional groups and a second compound having 1 to 8, preferably 1 to 6, more preferably 1 to 3 hydroxyl groups. Depending on the compounds selected and their relative amounts the ester may therefore comprise excess hydroxyl groups or excess acidic groups, or an excess of neither. The first compound preferably contains 4 to 36 carbon atoms, preferably 8 to 24 carbon atoms. The second compound preferably contains 1 to 8 carbon atoms, preferably 1 to 5 carbon atoms.

The esters may, for example, include a monooleate, dioleate, monostearate, distearate, monolaurate or dilaurate; or, in the case of a sorbitan compound, for example, a trioleate or tristearate, for example. Especially preferred are sorbitan esters, for example sorbitan monoesters such as sorbitan monooleate, and sorbitol triesters such as sorbitan trioleate. The esters may be alkoxylated, for example ethoxylated. Suitable dedicated asphaltene dispersants may include polyethylene glycol fatty acid esters. Examples include esters formed by the reaction of fatty acids having 6 to 30, preferably 8 to 24 carbon atoms with alcohols containing 1 to 20 ethylene oxide units.

Suitable dedicated asphaltene dispersants include lecithin and lecithin derivatives, for example soya lecithin.

Suitable dedicated asphaltene dispersants include succinimides and succinic anhydride derivatives of general formula:

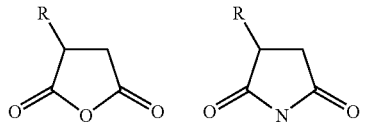

wherein R is an optionally substituted alkyl group, preferably having 1 to 50 carbon atoms. Most preferably R is a polyisobutyl chain.

Suitable dedicated asphaltene dispersants include poly (alkylene oxides), notably polyethylene oxide, polypropylene oxide and poly(ethylene oxide/propylene oxide), preferably ethylene oxide/propylene oxide block copolymers.

Suitable asphaltene dispersants include phenolic resins. Preferred phenolic resins include compounds of formula:

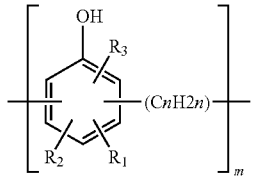

wherein m is at least 1; wherein n is at least 1; wherein the or each $R^1$, $R^2$ and $R^3$ are independently selected from hydrogen, alkyl groups, aromatic groups and heterocycles, or may be OH, hydrocarbyl groups, oxyhydrocarbyl groups, —CN, —$NO_2$, —$SO_3H$, —$SO_2H$, —COOH, —$COOR^4$, —$NH_2$, —$NHR^5$, —$SO_2NH_2$, —$SO_2$, —$NHR^6$, $CONH_2$, $CONHR^7$, SH and halogens; wherein each of $R^4$, $R^5$, $R^6$ and $R^7$ is independently selected from hydrocarbyl groups. The term "hydrocarbyl" as used herein means any one of an alkyl group, an alkenyl group, an alkenyl group, an acyl group, which groups may be linear, branched or cyclic, or an aryl group. The term hydrocarbyl also includes those groups but wherein they have been optionally substituted. If the hydrocarbyl is a branched structure having substituent(s) thereon, then the substitution may be on either the hydrocarbyl backbone or on the branch; alternatively the substitutions may be on the hydrocarbyl backbone and on the branch.

In one preferred aspect m is greater than 1. In one preferred aspect, m is 1 to 50, such as 1 to 40, 5 to 30, or 10 to 20. In a preferred aspect, m is 11 to 15.

n may be any suitable integer. For example n may be from 1 to 10 such as 1 to 8, 1 to 5 or 1, 2 or 3. Preferably n is 1.

Where n is greater than 1, the "linker" group $C_nH_{2n}$ may be branched.

Preferably $R^1$ is not hydrogen.

Preferably $R^1$ is an alkyl group having at least 1 carbon atom, preferably at least 5, or 6, or 7, or 8, or 9 carbons atoms.

Preferably $R^1$ is an alkyl group having up to 80 carbon atoms, preferably up to 50, or 32, or 30, or 28, or 26, or 24 carbon atoms.

In certain preferred embodiments $R^1$ is a preferably a $C_5$-$C_{20}$ alkyl group, preferably a $C_5$-$C_{15}$ alkyl group, preferably a $C_6$-$C_{12}$ alkyl group, preferably a $C_7$-$C_{11}$ alkyl group, preferably a $C_8$-$C_{10}$ alkyl group, more preferably a $C_9$ alkyl group.

In certain preferred embodiments $R^1$ is a preferably a $C_{12}$-$C_{32}$ alkyl group, preferably a $C_{16}$-$C_{28}$ alkyl group, preferably a $C_{20}$-$C_{24}$ alkyl group.

In one aspect, $R^1$ is a branched alkyl group, preferably a $C_{3-6}$ branched alkyl group, for example t-butyl.

In one aspect, $R^1$ is a straight chain alkyl group.

In one preferred aspect $R^1$ is para substituted relative to the OH group.

In one preferred aspect the $C_nH_{2n}$ group is ortho substituted relative to the OH group.

Preferably $R^1$ is para substituted relative to the OH group and the $C_nH_{2n}$ group(s) are ortho substituted relative to the OH group.

Preferably $R^2$ is hydrogen. Preferably $R^3$ is hydrogen. Preferably $R^2$ and $R^3$ are both hydrogen. In embodiments in which $R^2$ is not a hydrogen, $R^2$ is preferably an optionally substituted linear or branched alkyl group. In embodiments in which $R^3$ is not hydrogen, $R^3$ is preferably an optionally substituted linear or branched alkyl group.

A typical example of $R^2$ or $R^3$ is a tertiary alkyl group, such as a tertiary butyl group.

In a preferred aspect each of $R^2$ and $R^3$ is present as a substituent (rather than hydrogen), such that ring A is fully substituted.

In a preferred aspect the phenolic resin is a substituted phenolic resin. More preferably the phenolic resin is the reaction product of substituted phenol and an aldehyde.

More preferably the phenolic resin is the reaction product of substituted phenol and an aldehyde having 1-22, preferably 1-7 carbon atoms, for example formaldehyde.

In a preferred aspect the phenolic resin is a $C_9$-$C_{24}$ phenolic resin.

More preferably the phenol resin is the reaction product of $C_9$-$C_{24}$ phenol phenol and formaldehyde, or of t-butyl phenol and an aldehyde having 1-22, preferably 1-7, carbon atoms, for example formaldehyde.

Alkoxylated phenolic resins (ethoxylated and/or propoxylated) are available. Their use is not excluded, but it is not preferred, as excellent results have been obtained using non-alkoxylated phenolic resins.

A dedicated asphaltene dispersant can be present in any aspect of the present invention.

When a dedicated asphaltene dispersant (iii), is present it is preferably present at a concentration of 0.1 to 1,000 mg/kg, for example 10 to 200 mg/kg.

Further beneficial components which may be provided are as follows:

Fuel Antioxidants (iv)

Fuel instability may be promoted by oxidation of components of, or within, the fuel. This is a significant issue in the context of biofuels. This effect may be counteracted by fuel antioxidants. Fuel antioxidants can be present in any aspect of the present invention.

Fuel antioxidants (iv) suitable for use in the present invention include phenolic antioxidants, sulphurized phenolic antioxidants and aromatic amine antioxidants.

Preferred phenolic antioxidants are hydrocarbon soluble phenolic antioxidants and especially those in which at least one ortho position of the phenol is blocked. Suitable antioxidants include those of formula:

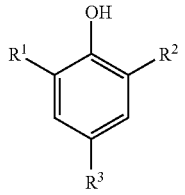

where $R^1$, $R^2$, and $R^3$ are the same or different and are each alkyl, aryl, alkylaryl, arylalkyl, hydroxyalkyl, hydroxyaryl, hydroxyalkylaryl, hydroxyarylalkyl groups, or heteroatomic alkyl, aryl, alkylaryl, arylalkyl, hydroxyalkyl, hydroxyaryl, hydroxyalkylaryl, hydroxyarylalkyl groups containing nitrogen, sulfur, or oxygen and where at least one of $R^1$ and $R^2$ provide stearic hindrance. $R^1$ and/or $R^2$ are preferably isobutyl or tertiary butyl groups. The hindered phenol is preferably either 2,6-di-tert-butyl-4-methylphenol or 6-tert-butyl-2,4-dimethylphenol. Further preferred examples include 2-tert-butylphenol, 2-ethyl-6-methylphenol, 2,6-di-tert-butyl-phenol, 2,6-di-tert-butyl-4-methylphenol, 2,2'-methylene-bis-4, 6di-tert-butyl-phenol, 4,4'-methylene-bis (2,6-di-tert-butyl-phenol) and 2,2'-propylidene-bis(6-tert-butyl-4-methylphenol). Mixtures of such antioxidants can also be used.

Also useful as stabilisers are sulfides having a general formula $R^4$—S—$R^5$ and phosphine compounds having a general formula $PR^6R^7R^8$ where $R^4$, $R^5$, $R^6$, $R^7$, and $R^8$ are the same or different and are each alkyl, aryl, alkylaryl, arylalkyl, hydroxyalkyl, hydroxyaryl, hydroxyalkylaryl, hydroxyarylalkyl groups, or heteroatomic alkyl, aryl, alkylaryl, arylalkyl, hydroxyalkyl, hydroxyaryl, hydroxyalkylaryl, hydroxyarylalkyl groups containing nitrogen, sulfur, or oxygen.

Additionally the compounds mentioned below as biofuel instability inhibitors may be useful as fuel antioxidants.

When a fuel antioxidant (iv) is present it is preferably present at a concentration of 0.1 to 1000 mg/kg.

Cold Flow Improvers (v)

A cold flow improver (v) may act in a fuel, especially a fuel which may freeze under ambient conditions (for example diesel), to maintain flow conditions under conditions which otherwise would cause freezing occur, and the fuel to become unusable. Cold flow improvers can be present in any aspect of the present invention.

Cold flow improvers useful as stabilisers in the present invention include copolymers of alkenes and unsaturated esters, alkylmethacrylate polymers, polyoxyalkylene esters, ethers, ester/ethers and mixtures thereof.

Examples of copolymers of alkenes and unsaturated esters include ethylene-unsaturated ester copolymers. Favoured are those having, in addition to units derived from ethylene, units of the formula $$—CR^1R^2—CHR^3—$$

wherein $R^1$ represents hydrogen or methyl; $R^2$ represents $COOR^4$, wherein $R^4$ represents an alkyl group having from 1 to 9 carbon atoms which is straight chain or, if it contains 3 or more carbon atoms, branched, or $R^2$ represents $OOCR^5$, wherein $R^5$ represents $R^4$ or H; and $R^3$ represents H or $COOR^4$. These may comprise a copolymer of ethylene with an ethylenically unsaturated ester, or derivatives thereof. An example is a copolymer of ethylene with an ester of a saturated alcohol and an unsaturated carboxylic acid, but preferably the ester is one of an unsaturated alcohol with a saturated carboxylic acid. An ethylene-vinyl ester copolymer is advantageous; an ethylene-vinyl acetate, ethylene-vinyl propionate, ethylene-vinyl hexanoate, or ethylene-vinyl octanoate copolymer is preferred. Preferably, the copolymer contains from 5 to 40 wt % of the vinyl ester, more preferably from 10 to 35 wt % vinyl ester. A mixture of two or more such copolymers, for example as described in U.S. Pat. No. 3,961,916, may be used. The number average molecular weight of the copolymer, as measured by vapour phase osmometry, is advantageously 1,000 to 10,000, preferably 1,000 to 5,000. If desired, the copolymer may contain units derived from additional comonomers, e.g. a terpolymer, tetrapolymer or a higher polymer, for example where the additional comonomer is isobutylene or disobutylene. The copolymers may be made by direct polymerization of comonomers, or by transesterification, or by hydrolysis and re-esterification, of an ethylene unsaturated ester copolymer to give a different ethylene unsaturated ester copolymer. For example, ethylene-vinyl hexanoate and ethylene-vinyl octanoate copolymers may be made in this way, e.g., from an ethylene-vinyl acetate copolymer.

Examples of alkyl (meth)acrylate polymers useful as cold flow improvers include copolymers consisting of 10 to 95 mol % of one or more alkyl acrylates or alkyl methacrylates with $C_1$- to $C_{26}$-alkyl chains and of 5 to 90 mol % of one or more ethylenically unsaturated dicarboxylic acids or their anhydrides, the copolymer having been extensively reacted with one or more primary or secondary amines to give the monoamide or amide/ammonium salt of the dicarboxylic acid. The copolymers preferably contain from 10 to 95, preferably 40 to 95, and most preferably 60 to 90, mol % of the one or more alkyl (meth)acrylates and from 5 to 90, preferably 5 to 60, and most preferably 10 to 40, mol % of the one or more ethylenically unsaturated dicarboxylic acids or anhydrides. The alkyl groups of the alkyl (meth)acrylates are said to contain from 1 to 26, preferably 4 to 22, and most preferably 8 to 18, carbon atoms. The alkyl groups are preferably straight-chained and unbranched. However, up to 20% w of cyclic and/or branched alkyl components may be present. Examples of particularly preferred alkyl (meth)acrylates are listed as n-octyl (meth)acrylate, n-decyl (meth)acrylate, n-dodecyl (meth)acrylate, n-tetradecyl (meth)acrylate, n-hexadecyl (meth)acrylate and n-octadecyl (meth)acrylate and mixtures of these. Examples of ethylenically unsaturated dicarboxylic acids are said to be maleic acid, tetrahydrophthalic acid, citraconic acid and itaconic acid and their anhydrides as well as fumaric acid. Maleic anhydride is preferred.

Examples of polyoxyalkylene esters, ethers, ester/ethers or mixtures thereof useful as cold flow improvers include those containing at least two $C_{10}$ to $C_{30}$ linear saturated alkyl groups and a polyoxyalkylene glycol of molecular weight 200 to 2,000, the alkylene group of said polyoxyalkylene glycol containing from 1 to 4 carbon atoms.

When a cold flow improver (v) is present it is preferably present at a concentration of 0.1 to 1000 mg/kg.

Wax Anti-Settling Agents (vi)

A wax anti-settling agent (vi) may act in a fuel, especially a fuel which may freeze under ambient conditions (for example diesel), to maintain flow conditions under conditions which otherwise would cause freezing to occur, and the fuel to become unusable. Wax anti-settling agents can be present in any aspect of the present invention.

Wax anti-settling agents useful as stabilisers in the present invention include certain polyimide and maleic anhydride olefin copolymers.

Suitable maleic anhydride olefin copolymer additives may be prepared by the reaction of maleic anhydride with an α-olefin. Generally such copolymer additives preferably contain substantially equimolar amounts of maleic anhydride and α-olefin. The operative starting α-olefin is a mixture of individual α-olefins having a range of carbon numbers. The starting α-olefin composition used to prepare the maleic anhydride olefin copolymer additive of the invention has at least a minimum α-olefin concentration by weight with a carbon number within the range from about $C_{20}$ to about $C_{40}$. The additive generally contains blends of α-olefins having carbon numbers within this range. The operative starting α-olefin may have a minor component portion which is outside the above carbon number range. The maleic anhydride α-olefin copolymers have a number average molecular weight in the range of about 1,000 to about 5,000 as measured by vapor pressure osmometry. Also suitable are wax anti-settling additives comprising an imide produced by the reaction of an alkyl amine, maleic anhydride and α-olefin. Generally the imide is produced from substantially equimolar amounts of maleic anhydride and α-olefin. The operative α-olefin is similar in composition to that described above for the maleic anhydride olefin copolymer additive. Particularly advantageous properties are obtained when the alkyl amine is tallow amine. The imide preferably has a number average molecular weight in the range of about 1,000 to about 8,000 as measured by vapor pressure osmometry.

Suitable wax anti-settling agents include additives of formula:

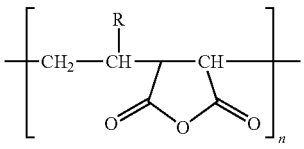

wherein R has at least 60% by weight of a hydrocarbon substituent from about 20 to about 40 carbons, and n is from about 2 to about 8. Preferably R has at least 70% by weight of a hydrocarbon substituent from about 20 to about 40 carbons, and most preferably R has at least 80% by weight of a hydrocarbon substituent from about 20 to about 40 carbons. In a preferred embodiment R has at least 60% by weight of a hydrocarbon substituent with a carbon number range from 22 to 38 carbons, more preferably at least 70% by weight, and most preferably at least 80% by weight. The resulting maleic anhydride α-olefin copolymer has a number average molecular weight in the range of about 1,000 to about 5,000, as determined by vapor pressure osmometry.

Also useful are wax anti-settling agents of formula:

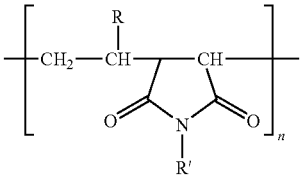

wherein R has at least 60% by weight of a hydrocarbon substituent from about 20 to about 40 carbons, R' has at least 80% by weight of a hydrocarbon substituent from 16 to 18 carbons, and n is from about 1 to about 8. Preferably R has at least 70% by weight of a hydrocarbon substituent from about 20 to about 40 carbons, and most preferably R has at least 80% by weight of a hydrocarbon substituent from about 20 to about 40 carbons. In a preferred embodiment R has at least 60% by weight of a hydrocarbon substituent with a carbon number range from 22 to 38 carbons, more preferably at least 70% by weight, and most preferably at least 80% by weight. Typically, R' has at least 90% by weight of a hydrocarbon substituent from 16 to 18 carbons. The above additive, described as an imide, has a number average molecular weight as determined by vapor pressure osmometry in the range of about 1,000 to about 8,000.

Further compounds alleged to be useful as wax anti-settling agents and/or as cold flow inhibitors are described in EP-A-743972 and EP-A-743974, and the contents of these specifications are incorporated herein by reference.

When a wax anti-settling agent (vi) is present it is preferably present at a concentration of 0.1 to 1000 mg/kg.

Biofuel Instability Inhibitors (vii)

Biofuel instability inhibitors (vii) function mainly to disperse polymers or high molecular weight compounds either found in the biofuels as the bi-product of oxidation or thermal breakdown. Biofuel instability inhibitors can be present in any aspect of the present invention. A non exclusive list of chemistries which are applicable to perform this function include polymers of: ethylene and unsaturated esters; vinyl alcohols, vinyl ethers and their ester with organic acids; propylene, ethylene, isobutylene adducts with unsaturated carboxylic acids (such as maleic and fumaric acids) and their amide or imide derivatives; acrylic acids and their amide or esters derivatives; polystyrenes; and polymers made from combinations of these monomers. Additionally the compounds mentioned above as fuel antioxidants may be useful as biofuel instability inhibitors. Biofuel instability inhibitors can be present in any aspect of the present invention.

When a biofuel instability inhibitor (vii) is present it is preferably present at a concentration of 0.1 to 1000 mg/kg.

Blended Fuel Separation Inhibitors (viii)

A blended fuel separation inhibitor (viii) herein acts to maintain two or more fuels in a dispersed or blended form. Blended fuel separation inhibitors can be present in any aspect of the present invention. Loss of uniformity and mobility of fuel may also occur when there is phase separation within such a fuel. Fuel blends may commonly in-tank be made when ships dock and may source whatever fuel is available at the locality at a favourable price. Lack of stability may occur, for example, when two or more different distilled fuels are blended, or when a biofuel is blended with a distilled fuel.

Many compounds as blended fuel separation inhibitors include compounds described above as stabilisers of other type, and need not be repeated here.

When a blended fuel separation inhibitor (viii) is present it is preferably present at a concentration of 0.1 to 1000 mg/kg.

Additive Composition

In accordance with a sixth aspect of the present invention there is provided an additive composition comprising:

(i) a conductivity improver effective as an anti-separation agent in a hydrocarbon composition;

and, at least one of:

(ii) a combustion improver selected from:

(iia) a metal compound selected from an iron compound, a manganese compound, a calcium compound, a cerium compound and mixtures thereof, and/or (iib) an organic compound selected from a bicyclic monoterpene, a substituted bicyclic monoterpene, adamantane, a substituted or unsubstituted bicyclic tetraterpene, propylene carbonate and mixtures thereof; and (iii) a dedicated asphaltene dispersant compound.

Preferably the additive composition is a liquid. The additive composition preferably includes a diluent.

The diluent to be used should be readily fuel soluble and compatible, including with respect to boiling point range, and preferably will have a flash point in excess of 62° C. for ease of storage. Ideal diluents are those in which all the active ingredients dissolve equally well and which form a solution which is stable over prolonged storage periods, and also under cold conditions.

Where the additive combination is intended to be added as an 'aftermarket' treatment, the volume of diluent used will be such as to provide a non-viscous liquid, suitable for use in a dispenser bottle or syringe pack.

Preferably the diluent is selected from an aromatic compound, a hydrocarbon compound and mixtures thereof. Generally the diluent may be a crude oil distillation product selected from kerosene, cracked gas oil, vacuum gas oil, long residue, short residue, heavy naphtha, light gas oil, medium gas oil, heavy gas oil, cycle oil, gasoline, diesel and mixtures thereof.

The diluent may be a "paraffin compound", which may include both straight chain and branched chain compounds. The branched chain compounds are also known as iso-paraffins.

Preferred additional components of the additive composition include any one or more of:

a fuel antioxidant (iv), a cold flow improver (v), a wax anti-settling agent (vi), a biofuel instability inhibitor (vii), a blended fuel separation inhibitor (viii).

It should be noted that further components are not excluded. The essential requirement of the present invention is that components (i) and (ii) are present in the additive composition.

A preferred additive composition comprises:

1-1000 parts (i), preferably 2-200 parts (i), preferably 5-50 parts (i);

1-300 parts (iia), preferably 2-50 parts (iia) when present, and/or 1-300 parts (iib), preferably 2-50 parts (iib) when present (at least one compound of (iia) and (iib) being present;

1-1000 parts (iii), preferably 5-100 parts (iii), preferably 2-50 parts (iii)—when present;

1-1000 parts (iv), preferably 5-100 parts (iv), preferably 2-50 parts (iv)—when present;

1-1000 parts (v), preferably 5-100 parts (v), preferably 2-50 parts (v)—when present;

1-1000 parts (vi), preferably 5-100 parts (vi), preferably 2-50 parts (vi)—when present;

1-1000 parts (vii), preferably 5-100 parts (vii), preferably 2-50 parts (vii)—when present;

1-1000 parts (viii), preferably 5-100 parts (viii), preferably 2-50 parts (viii)—when present;

all parts being by weight.

Although separate addition of components is not excluded and may in some circumstances be convenient, it is envisaged that components will be added as an additive composition or package containing each component to be delivered.

The advantages of an additive composition are quite clear. Fuels to which no additive has been added can be transformed into fuel compositions according to the invention, by adding a corresponding quantity of the additive composition to the hydrocarbon mixture and preferably mixing it so that it is homogeneous. It would also be possible to add corresponding amounts of components (i), (iia) and/or (iib) (and other compounds) separately to the mixture. However, it would not only be necessary to ensure the concentrations of each in the fuel, but also the correct relation of the individual components to one another. Therefore it is simpler and more customer-friendly to offer an additive composition which already contains the components in the correct relation to one another.

An important quality consideration for hydrocarbon is the propensity of the hydrocarbon to separate out asphaltenes or other poorly soluble materials from the oil phase, forming an extremely undesirable two-phase system. This phenomenon is described in petroleum technology as the stability reserve of the fuel.

The process of maintaining a colloidal dispersion of asphaltenes in crude oils or heavy fuel oils is defined as peptization, where as the aggregation of colloidally dispersed asphaltenes into visibly larger masses that may or may not settle out is defined as flocculation.

Thus in the petroleum industry the stability reserve of a hydrocarbon (oil) is the property of the hydrocarbon to maintain asphaltenes in a peptized state and prevent their flocculation.

A hydrocarbon with a low stability reserve is likely to undergo flocculation of asphaltenes when stressed (for example, extended heated storage) or blended with a range of other oils.

The stability reserve of a hydrocarbon is estimated by separability number of the hydrocarbon. This can be measured by the separability number test method ASTM D-7061-04.

Hydrocarbons with a high separability number can indicate that the hydrocarbon has a low stability reserve, and conversely a hydrocarbon with a low separability number can indicate that the oil has a high stability reserve.

When the separability number is from 0 to 5, the hydrocarbon can be considered to have a high stability reserve and asphaltenes are not likely to flocculate.

If the separability number is from 5 to 10, the stability reserve in the hydrocarbon will be much lower. However, asphaltenes are, in this case, not likely to flocculate as long as the hydrocarbon is not exposed to any worse conditions, such as storing, aging, and heating.

If the separability number is above 10, the stability reserve of the hydrocarbon is very low and asphaltenes will easily flocculate, or have already started to flocculate.

Preferably the hydrocarbon composition has a separability number which is less than the separability number of the base hydrocarbon, without the conductivity improver; and preferably the ratio of the former to the latter is not greater than 0.9, preferably not greater than 0.85.

Conductivity additives as described in the present invention separately or in combination with a dedicated asphaltene dispersant enhance the stability reserve of a hydrocarbon as measured by the hydrocarbon separability number.

All numerical definitions given herein may be treated as though they were preceded with the word "about".

EXAMPLES

The stability reserve of a hydrocarbon as well as the enhancement of hydrocarbon stability reserve by utilization of conductivity additives described in the invention were evaluated by measuring the hydrocarbon separability number.

Separability Number Test Method:

The Separability Number of the hydrocarbon is measured by using procedures described in ASTM D-7061-04 *Standard Test Method for Measuring n-Heptane Induced Phase Separation of Asphaltene-Containing Heavy Fuel Oils as Separability Number by an Optical Scanning Device*, the entire teaching of which is incorporated herein by reference In D-7061-04, the fuel under test is diluted with toluene and the oil/toluene mixture is added to heptane in a tube. The tube is shaken and put in a vertical orientation into a Turbiscan optical scanning device, available from Formulaction of Toulouse, France. The Turbiscan device has a vertically moveable light source and detector, and constantly scans the tube vertically, completing a traverse of the tube, (i.e. from one end to the other) once a minute. As heptane-induced flocculation of asphaltenes occurs, the light transmittance through the fuel sample increases, starting at the top of the tube. By calculating the average transmittance through the sample per minute along the tube the separability number is obtained by a standard Turbiscan calculation method.

Combustion improvement may be assessed by the simple and practical test of burning an additized fuel, particularly a fuel heavier than would normally be combusted in the given engine or boiler, and inspecting the exhaust gases (collecting soot and ash by filtration, if wished) and, after a suitable interval, engine parts, fuel injectors, turbochargers and any heat recovery equipment.

The invention will now be further described, by way of illustration only, with reference to the following examples.

Materials

Conductivity Improver A

This is a 50/50 (w/w) mixture of Conductivity Improvers D and F below.

Conductivity Improver B

Conductivity Improver B was selected from the polysulfone/polyamine conductivity class of additives, the preparation of which is described in U.S. Pat. No. 3,917,466. Conductivity Improver B is believed to contain approximately 20% w/w of active conductivity improving compounds.

Conductivity Improver C

Into an autoclave, 2940 g of 1-decene, 5250 g of toluene, 59 g of dodecyl mercaptan and 88 g of a 75% solution of t-butyl peroxypivalate in neutral mineral spirits were charged. The autoclave was sealed, swept twice with nitrogen and evacuated. Sulfur dioxide, 1984 g, was then added to the autoclave. The reaction mixture was heated to 38 to 42° C. with agitation for 10 hours. The autoclave was cooled to room temperature and sparged with nitrogen to remove unreacted $SO_2$. The reaction mixture was filtered to provide approximately 9 kg of a clear, pale yellow, viscous solution containing 40% by weight of 1-decene polysulfone.

Conductivity Improver D

Into a reaction flask equipped with a stirrer, a reflux condenser, a thermometer and an addition funnel, and containing 110 g (0.33 mole) of N-tallow-1,3-diaminopropane, 110 ml of xylene and 30 ml of isopropanol heated at 55 to 60° C., was added 31 g (0.33 mole) of epichlorohydrin in 75 ml of xylene. The reaction mixture was kept at 55 to 60° C. for 1.5 hour. The temperature was then raised to 80° C. and held at 80° C. for 2.5 hours. Solid sodium hydroxide, 13.3 g, was then added, the temperature raised to 90° C. and kept at 90° C. for 2 hours. The reaction mixture was cooled to room temperature, and filtered to provide an amber solution. Removal of the solvents by distillation at reduced pressures provided polymeric polyamine as a viscous polymer. The viscous polymer was then diluted to approximately 30% with toluene.

Conductivity Improver E

This is a 50/50 mixture of Conductivity Improver C above and a quartenary ammonium compound as described in U.S. Pat. No. 3,811,848. Conductivity Improver E is believed to contain 20 wt % polysulphone, 35 wt % of the quartenary ammonium compound, and the remainder, solvent(s).

Conductivity Improver F

Into a three necked flask fitted with stirrer, thermometer, and nitrogen purge was placed 100 ml of 1,2 dichloroethane, 13.25 g acrylonitrile and 6.7 g of aluminium chloride. An exotherm occurred and the reaction flask was cooled externally. 21 g of octadecene-1 and 0.7 g of azobis-isobutyronitrile were then added and the reaction system was purged with dry nitrogen for 1 hour. The temperature was slowly raised to 65° C., and the polymerization was allowed to proceed for 24 hours. The total viscous mass was poured into an excess of methanol-water and the aluminium salts were washed out. The solvent was removed. The yield of polymer was 31 g. The product was diluted in toluene to approximately 30%.

Conductivity Testing and Results

The conductivity enhancement of hydrocarbon test samples respectively containing Conductivity Improver A-F was evaluated using ASTM 2624-02, *Standard Test Methods for Electrical Conductivity of Aviation and Distillate Fuels*. For these conductivity tests the hydrocarbon used was a paraffinic hydrocarbon commercially available from Exxon Mobil Corporation under the brand name Isopar M.

| Conductivity improver | Conductivity in ISOPAR M pS/m | Treat Rate, (Total mg/l) | Treat Rate (Active mg/l) |
|---|---|---|---|
| A | 300 | 9.63 | Approx 2.9 |
| B | 450 | 2.85 | Approx 0.57 |
| C | 32 | 10 | Approx 4.0 |
| D | 73 | 100 | Approx 30 |
| E | 1270 | 10 | Approx 5.5 |
| F | 74 | 10 | Approx 3.0 |

Separability Testing and Results—Set A (Conductivity Improvers A and B)

A common bunker fuel (Bunker Fuel Sample I herein) was used for the evaluation. The Separability Number of the bunker fuel with and without conductivity improver was evaluated in accordance with ASTM D-7061-04 (Turbiscan Test).

Conductivity Improver A

Results of the Turbiscan Test for Bunker Fuel Sample I using Conductivity improver A are as follows:

| Conductivity Improver A (mg/l) | Turbiscan Stability Index |
|---|---|
| 0 | 13.1 |
| 10,000 | 0.16 |

10,000 mg/l of Conductivity Improver A corresponds to approximately 3,000 mg/l of active conductivity improving compounds.

Conductivity Improver B

The effect of Conductivity Improver B on the hydrocarbon Separability Number was also evaluated. A different bunker fuel (Bunker Fuel Sample II herein) was used. Bunker Fuel Sample II's chemical composition was determined by HPLC as: 10.7% w/w saturates, 69.0% w/w; 16.4% w/w asphaltenes and 4% w/w resins. Its viscosity at 50° C. was 195 mPas measured using a cone and plate viscometer.

The Separability Number of Bunker Fuel Sample II with and without Conductivity Improver B was evaluated in accordance with ASTM D 7061-04 (Turbiscan Test).

The results of the Turbiscan test for Bunker Fuel Sample II are as follows:

| Conductivity Improver B (mg/kg) | Turbiscan Stability Index |
|---|---|
| 0 | 9.8 |
| 92 | 11.12 |
| 184 | 7.5 |
| 345 | 3.1 |
| 506 | 0.1 |
| 10,000 | 0.1 |
| 100,000 | 0.1 |

Separability Testing and Results—Set B (Different Fuels)

Different fuels, all having a tendency to separate, were used for these evaluations. Again, the Separability Numbers of the fuels were evaluated in accordance with ASTM D-7061-04 (Turbiscan Test).

Nevsky High Sulphur Heavy Fuel Oil
base value (no additive) of 12.24

| Conductivity Improver | 0 ppm | 100 ppm | 500 ppm |
|---|---|---|---|
| A | 12.24 | 0.618 | 0.39 |
| B | 12.24 | 2.75 | 0.38 |
| C | 12.24 | 9.38 | 0.365 |
| D | 12.24 | 0.365 | 5 |
| E | 12.24 | 10.8 | 0.155 |
| F | 12.24 | 10.4 | 0.14 |

Nevsky High Sulphur Heavy Fuel Oil
base value (no additive) of 8.6

| Additive | 10 ppm |
|---|---|
| Comparison A | 0.25 |
| 1:1 (wt:wt) Conductivity Improver A and Comparison A | 0.25 |

Comparison A was a standard stability improving compound marketed for that purpose. This result (and the results which follow, relating to different fuel oils) suggests that using a half quantity of the standard product together with an equivalent amount of Conductivity Improver A gives no diminution of anti-separability performance.

Generic Fuel Oil
base value (no additive) of 7.7

| Additive | 20 ppm |
|---|---|
| Comparison A | 0.022 |
| 1:1 (wt:wt) Conductivity Improver A and Comparison A | 0.021 |

Generic Fuel Oil
base value (no additive) of 13.1

| Additive | 20 ppm |
|---|---|
| Comparison A | 0.079 |
| 1:1 (wt:wt) Conductivity Improver A and Comparison A | 0.038 |

The findings reported above indicate that the use of conductivity improvers as described in the present invention result in a great enhancement of the stability reserve for a given hydrocarbon. The unexpected increase in stability reserve by utilization of conductivity additives functioning as anti-separation agents as described herein had heretofore been unknown in the fuel/fuel additives industry.

The results also indicate that the conductivity improvers as described in the present invention may be used in conjunction with conventional stability enhancement compounds, with the latter in reduced amount, with maintenance of excellent performance.

Generally, hydrocarbon compositions of the invention show good properties in terms of Separability Number (less than 5; generally less than 1), and good combustion performance has been observed.

While certain embodiments of the present invention have been disclosed in detail, it is to be understood that various modifications may be adopted without departing from the spirit of the invention or scope of the following claims.

The invention claimed is:

1. A method of improving the stability reserve of a hydrocarbon fuel composition comprising:

a) providing a hydrocarbon fuel composition having a separability number of at least 5;

b) adding a conductivity improver to the hydrocarbon composition in an amount of at least 100 mg/kg; and c) lowering the separability number to less than 5.

2. The method of claim 1 further comprising optionally adding (a) a metal compound selected from the group consisting of an iron compound, a manganese compound, a calcium compound, a cerium compound and mixtures thereof; and/or (b) an organic compound selected from the group consisting of a bicyclic monoterpene, a substituted bicyclic monoterpene, adamantane, a substituted or unsubstituted bicyclic tetraterpene, propylene carbonate and mixtures thereof.

3. The method of claim 1 wherein said conductivity improver is selected from the group consisting of a polysulfone, a nitrogen-containing polymer, a polyamine, a quaternary ammonium compound, an acrylonitrile copolymer, a copolymer of alkylvinylmonomers and cationic vinyl monomers, an olefin maleic anhydride copolymer, reaction products of an amine and methyl vinyl ether-maleic anhydride copolymers, and mixtures thereof.

4. The method of claim 2 wherein said metal compound is an iron complex selected from the group consisting of bis-cyclopentadienyl iron, substituted bis-cyclopentadienyl iron, overbased iron soaps and mixtures thereof.

5. The method of claim 4 wherein said metal compound is ferrocene.

6. The method of claim 2 wherein said organic compound is camphor.

7. The method of claim 1 further comprising a dedicated asphaltene dispersant.

8. A method of improving the stability reserve of a hydrocarbon fuel composition comprising:

a) providing a hydrocarbon fuel composition having a separability number of at least 5;

b) adding a conductivity improver to the hydrocarbon composition in an amount of at least 20 mg/kg; and c) lowering the separability number to less than 5.

9. The method of claim 8 further comprising optionally adding (a) a metal compound selected from the group consisting of an iron compound, a manganese compound, a calcium compound, a cerium compound and mixtures thereof; and/or (b) an organic compound selected from the group consisting of a bicyclic monoterpene, a substituted bicyclic monoterpene, adamantane, a substituted or unsubstituted bicyclic tetraterpene, propylene carbonate and mixtures thereof.

10. The method of claim 8 wherein said conductivity improver is selected from the group consisting of a polysulfone, a nitrogen-containing polymer, a polyamine, a quaternary ammonium compound, an acrylonitrile copolymer, a copolymer of alkylvinylmonomers and cationic vinyl monomers, an olefin maleic anhydride copolymer, reaction products of an amine and methyl vinyl ether-maleic anhydride copolymers, and mixtures thereof.

11. The method of claim 9 wherein said metal compound is an iron complex selected from the group consisting of bis-cyclopentadienyl iron, substituted bis-cyclopentadienyl iron, overbased iron soaps and mixtures thereof.

12. The method of claim 11 wherein said metal compound is ferrocene.

13. The method of claim 9 wherein said organic compound is camphor.

14. The method of claim 8 further comprising a dedicated asphaltene dispersant.

15. The method of claim 1 wherein the hydrocarbon fuel composition comprises asphaltenes.

16. The method of claim 8 wherein the hydrocarbon fuel composition comprises asphaltenes.

* * * * *